US009061751B2

(12) United States Patent
Tanaka et al.

(10) Patent No.: US 9,061,751 B2
(45) Date of Patent: Jun. 23, 2015

(54) MARINE PROPULSION DEVICE

(71) Applicant: YAMAHA HATSUDOKI KABUSHIKI KAISHA, Iwata-shi, Shizuoka (JP)

(72) Inventors: Seiichi Tanaka, Shizuoka (JP); Takahiro Oguma, Shizuoka (JP); Yoshihiko Okabe, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 155 days.

(21) Appl. No.: 13/788,126

(22) Filed: Mar. 7, 2013

(65) Prior Publication Data

US 2013/0312559 A1 Nov. 28, 2013

(30) Foreign Application Priority Data

May 25, 2012 (JP) ..... 2012-119449

(51) Int. Cl.
*B63H 23/30* (2006.01)
*B63H 20/20* (2006.01)

(52) U.S. Cl.
CPC ..... *B63H 23/30* (2013.01); *Y10T 74/19642* (2015.01); *Y10T 74/19693* (2015.01); *B63H 20/20* (2013.01)

(58) Field of Classification Search
CPC ..... B63H 20/20; B63H 23/34; B63H 23/00; F16D 41/12; F04D 13/021
USPC ..... 440/52, 53, 75, 83, 86; 464/83, 91, 157, 464/160, 180; 192/21, 43, 46, 48.92, 51
See application file for complete search history.

(56) References Cited

U.S. PATENT DOCUMENTS

| | | | | |
|---|---|---|---|---|
| 4,262,786 | A * | 4/1981 | Taylor | 192/46 |
| 6,322,407 | B1 | 11/2001 | Onoue | |
| 2004/0180586 | A1 | 9/2004 | Yasuda et al. | |
| 2008/0268726 | A1 | 10/2008 | Akuzawa | |

FOREIGN PATENT DOCUMENTS

| | | | |
|---|---|---|---|
| JP | 04-266593 | A | 9/1992 |
| JP | 2000-280983 | A | 10/2000 |
| JP | 2004-276726 | A | 10/2004 |
| JP | 2006-183694 | A | 7/2006 |
| JP | 2008-274970 | A | 11/2008 |

* cited by examiner

*Primary Examiner* — Lars A Olson
(74) *Attorney, Agent, or Firm* — Keating & Bennett, LLP

(57) ABSTRACT

A marine propulsion device includes a motive force transmission system, a propeller shaft, a housing section, and a clutch. The motive force transmission system includes a crank shaft and a drive shaft which transmits a motive force from the crank shaft. The propeller shaft transmits the motive force from the drive shaft. The housing section houses the motive force transmission system. The clutch is attached between the motive force transmission system and the housing section. The clutch permits relative rotation between the motive force transmission system and the housing section by opening a connection between the motive force transmission system and the housing section during normal rotation of the motive force transmission system. The clutch prevents relative rotation between the motive force transmission system and the housing section by connecting the motive force transmission system and the housing section during a reverse rotation of the motive force transmission system.

17 Claims, 13 Drawing Sheets

MARINE PROPULSION DEVICE

BACKGROUND OF THE INVENTION

1. Field of the Invention

The present invention relates to a marine propulsion device.

2. Description of the Related Art

In an outboard motor, it is possible for a phenomenon to occur in which an engine is driven in a reverse direction (referred to below as an "inversion phenomenon") by the propeller being rotated in a reverse orientation to a drive direction due to a torque applied by a water current. The cause for the occurrence of such an inversion phenomenon is described below. First, a boat operator sets a shift state to a neutral position in order to decelerate during forward progression. However, when a boat continues forward progression due to inertia, the propeller rotates normally due to water current hitting against the propeller. Next, the boat operator sets the shift state to a reverse position in order to further decelerate. At this time, if a rotation torque of the propeller due to the water current is larger than the engine drive torque, the engine stops, and is then driven in the reverse direction. When the engine is driven in the reverse direction, water is drawn into an exhaust passage due to a pump action of a cylinder. In this case, when water infiltrates into the cylinder, there is a possibility that the engine is damaged. Alternatively, there is a possibility that a catalyst is damaged due to submersion of the catalyst in water in the exhaust passage.

In an outboard motor disclosed in Japanese Laid-open Patent Application Publication No. H4-266593, a one-way clutch is disposed between a drive shaft and a pinion gear. In the outboard motor disclosed in Japanese Laid-open Patent Application Publication No. 2004-276726, a vertical shaft is divided into a first shaft and a second shaft, and an electromagnetic clutch is disposed between the first shaft and the second shaft. Both of these apparatuses have a structure in which the one-way clutch is engaged during transmission of a motive force from the engine to the propeller shaft, and the one-way clutch is disengaged and a motive force is not transmitted from the propeller shaft to the engine.

In addition, in a marine propulsion apparatus disclosed in Japanese Laid-open Patent Application Publication No. 2000-280983, the drive shaft is divided into a drive-side portion and a driven-side portion and a buffer apparatus is disposed between the drive-side portion and the driven-side portion. In the outboard motor disclosed in Japanese Laid-open Patent Application Publication No. 2006-183694, the drive shaft is divided into an upper drive shaft and a lower drive shaft and a damper structure is disposed between the upper section drive shaft and the lower section drive shaft. Both of these apparatuses have a structure in which the drive shaft is divided into two members and in which transmission of a motive force from the propeller shaft to the engine is controlled using a buffer member which is disposed between the two drive shaft members.

In addition, in the marine propulsion apparatus disclosed in Japanese Laid-open Patent Application Publication No. 2008-274970, the inversion phenomenon is detected by detecting a rotation angle of the crank shaft. In a case in which the inversion phenomenon is detected, the marine propulsion apparatus prevents the infiltration of water into the engine by forcibly transferring the shift gear to the neutral state.

SUMMARY OF THE INVENTION

In the apparatuses described above, it is possible to block or prevent the motive force which is transmitted from the propeller shaft to the engine due to the inversion phenomenon. However, it is necessary that the apparatuses of Japanese Laid-open Patent Application Publication No. H4-266593 and Japanese Laid-open Patent Application Publication No. 2004-276726 be segmented into an upstream portion and a downstream portion from a one-way clutch in a motive force transmission system in order to disengage the one-way clutch to block the motive force. As a result, there is a possibility that the durability of the motive force transmission system will be reduced during a normal motion since a portion that includes the one-way clutch is weak. The apparatuses of Japanese Laid-open Patent Application Publication No. 2000-280983 and Japanese Laid-open Patent Application Publication No. 2006-183694 have a similar problem to the apparatuses of Japanese Laid-open Patent Application Publication No. H4-266593 and Japanese Laid-open Patent Application Publication No. 2004-276726. Furthermore, in the apparatuses of Japanese Laid-open Patent Application Publication No. 2000-280983 and Japanese Laid-open Patent Application Publication No. 2006-183694, there is a possibility that the durability will be further reduced since the buffer member is made from a resin or the like.

In addition, in the apparatus of Japanese Laid-open Patent Application Publication No. 2008-274970, the shift state is transferred to the neutral state by operating a dog clutch after the inversion phenomenon is detected. As a result, a time lag occurs until the motive force in the reverse direction is blocked, and there is a possibility that infiltration of water into the engine will occur during the time lag.

In order to overcome the problems described above, preferred embodiments of the present invention provide a marine propulsion device in which it is possible to prevent the occurrence of an inversion phenomenon while maintaining the durability of a motive force transmission system.

A marine propulsion device according to a preferred embodiment of the present invention includes a motive force transmission system, a propeller shaft, a housing section, and a clutch. The motive force transmission system includes a crank shaft and a drive shaft which transmits a motive force from the crank shaft. The propeller shaft transmits the motive force from the drive shaft. The housing section houses the motive force transmission system. The clutch is attached between the motive force transmission system and the housing section. The clutch is configured to permit relative rotation between the motive force transmission system and the housing section by opening a connection between the motive force transmission system and the housing section during a normal rotation, i.e., a forward rotation, of the motive force transmission system. The clutch is configured to prevent the relative rotation between the motive force transmission system and the housing section by closing the connection between the motive force transmission system and the housing section during a reverse rotation of the motive force transmission system.

In a marine propulsion device according to a preferred embodiment of the present invention, the clutch connects the motive force transmission system and the housing section during the reverse rotation of the motive force transmission system. As a result of this arrangement, the relative rotation between the motive force transmission system and the housing section is prevented. That is, occurrence of the inversion phenomenon is prevented. Furthermore, it is possible to swiftly and effectively prevent an occurrence of the inversion phenomenon since detection of the inversion phenomenon and control of the shift state are not necessary. In addition, the clutch opens the connection of the motive force transmission system and the housing section during normal rotation of the motive force transmission system. As a result of this arrangement, the clutch permits the relative rotation between the motive force transmission system and the housing section during normal rotation of the motive force transmission system. Accordingly, it is not necessary to segment the upstream portion and the downstream portion of the clutch. As a result, it is possible to maintain the durability of the motive force transmission system.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
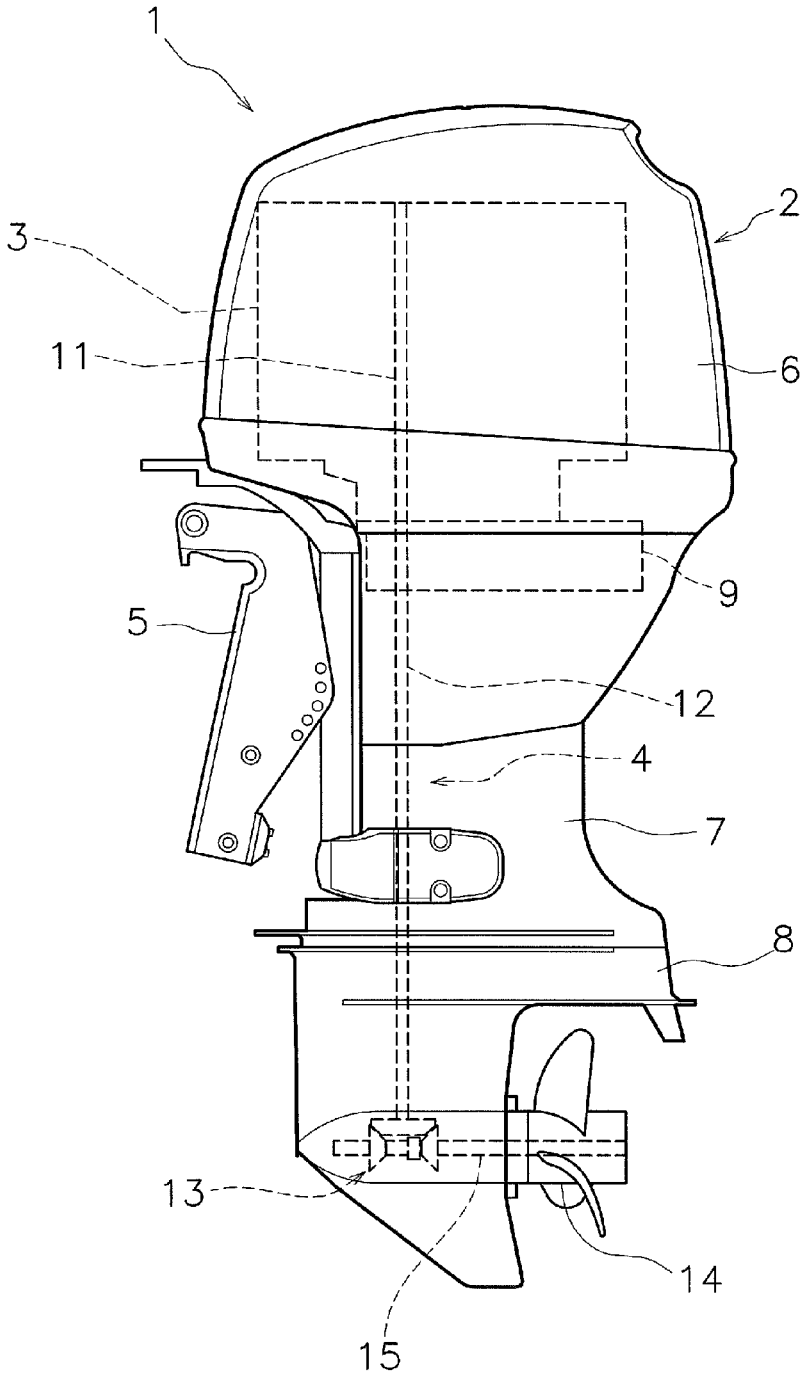
FIG. 1 is a side view diagram of a marine propulsion device according to a first preferred embodiment of the present invention.

Below, a marine propulsion device according to a first preferred embodiment of the present invention will be described with reference to the drawings. FIG. 1 is a side view diagram illustrating a marine propulsion device 1 according to the first preferred embodiment of the present invention. The marine propulsion device 1 is preferably an outboard motor. The marine propulsion device 1 includes an engine cover 6, an upper casing 7, a lower casing 8, an engine 3, and a bracket 5. The engine cover 6 houses the engine 3. The upper casing 7 is disposed below the engine cover 6. The lower casing 8 is disposed below the upper casing 7. The marine propulsion device 1 is attached to a boat (not shown) via the bracket 5.

The engine 3 is disposed within the engine cover 6. The engine 3 is disposed on an exhaust guide 9. The exhaust guide 9 is disposed within the upper casing 7. For example, the engine 3 is a multicylinder engine, and includes a plurality of cylinders, a crank shaft 11, and a case section 10 which will be described below with reference to FIG. 13. The case section 10 includes a crank case 10*a* and a cylinder body 10*b*. The crank shaft 11 is housed within the case section 10 of the engine 3. Specifically, the crank shaft 11 is supported by being interposed between the crank case 10*a* and the cylinder body 10*b*. The cylinders are preferably lined up in an up-down direction. The cylinders are preferably oriented in a horizontal direction. The case section 10 is defined by a housing section 2 along with the engine cover 6, the upper casing 7, and the lower casing 8.

The marine propulsion device 1 includes a motive force transmission system 4. The motive force transmission system 4 is housed in the housing section 2. The motive force transmission system 4 includes the crank shaft 11 described above, a drive shaft 12, and a forward and backward progression switching mechanism 13. The crank shaft 11 outputs a motive force from the engine 3. The crank shaft 11 preferably extends along a vertical direction. The drive shaft 12 transmits the motive force from the crank shaft 11. The drive shaft 12 is disposed within the upper casing 7 and the lower casing 8. The drive shaft 12 is disposed along an up-down direction within the upper casing 7 and the lower casing 8. An upper edge of the drive shaft 12 is linked to a lower edge of the crank shaft 11.

A propeller 14 is disposed in a lower section of the lower casing 8. The propeller 14 is disposed below the engine 3. The propeller 14 is linked to a propeller shaft 15. The propeller shaft 15 is preferably perpendicular to the drive shaft 12. The propeller shaft 15 is disposed along the front-back direction. The propeller shaft 15 is rotationally driven by the motive force transmitted from the drive shaft 12.

The propeller shaft 15 is linked to a lower section of the drive shaft 12 via the forward and backward progression switching mechanism 13. The forward and backward progression switching mechanism 13 is configured to switch the transmission direction of rotation of the propeller shaft 15 from the drive shaft 12. Accordingly, the motive force transmission system 4 rotates in the same direction during either the forward progression or the backward progression, but the propeller shaft 15 rotates in different directions during the forward progression and the backward progression of the marine propulsion device 1.

Figure 2:
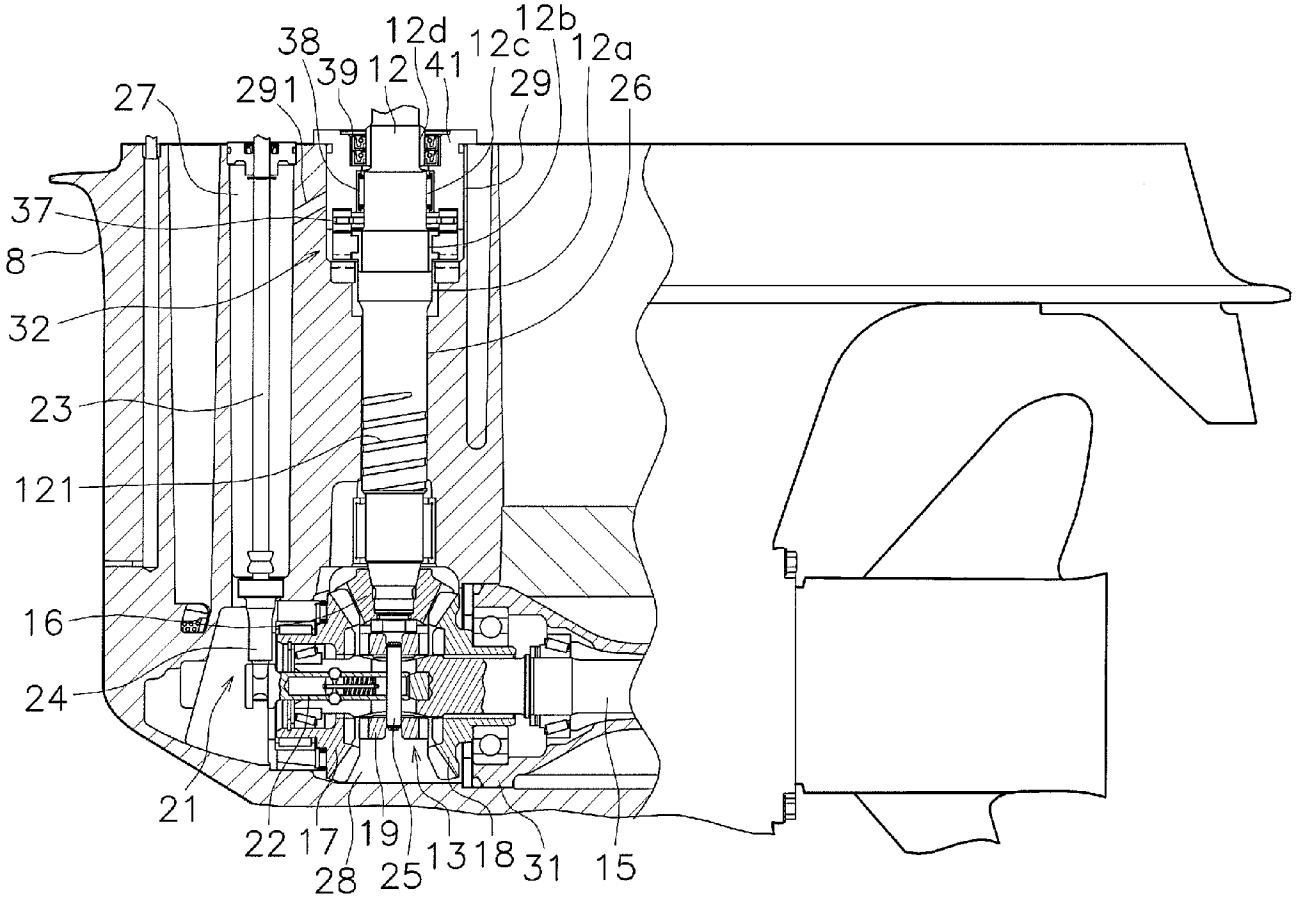
FIG. 2 is a cross-sectional diagram illustrating a structure within a lower casing of the marine propulsion device according to the first preferred embodiment of the present invention.

The forward and backward progression switching mechanism 13 is disposed within the lower casing 8. FIG. 2 is a partial cross-sectional diagram illustrating the configuration inside the lower casing 8. As shown in FIG. 2, the forward and backward progression switching mechanism 13 includes a pinion gear 16, a forward progression bevel gear 17, a backward progression bevel gear 18, and a dog clutch 19. The pinion gear 16 is connected to a lower edge of the drive shaft 12. The pinion gear 16 is engaged with the forward progression bevel gear 17 and the backward progression bevel gear 18.

The dog clutch 19 is attached to the propeller shaft 15 such that relative rotation therebetween is not possible. Accordingly, the dog clutch 19 integrally rotates with the propeller shaft 15. The dog clutch 19 can be selectively engaged with one of the forward progression bevel gear 17 and the backward progression bevel gear 18. The dog clutch 19 is arranged so as to move to a forward progression position, a backward progression position, or a neutral position along an axial direction of the propeller shaft 15.

The marine propulsion device 1 includes a shift apparatus 21. The dog clutch 19 is moved to the forward progression position, the backward progression position, and the neutral position by the shift apparatus 21. The shift apparatus 21 includes a shift sleeve 22, a shift rod 23, and a link member 24. The shift sleeve 22 is disposed within the propeller shaft 15. The shift sleeve 22 is attached so as to be able to move along the axial direction of the propeller shaft 15. One edge of the shift sleeve 22 is attached to the dog clutch 19 via an attachment pin 25. The other edge of the shift sleeve 22 is attached to a lower edge section of the shift rod 23 via the link member 24. The shift rod 23 rotates by being coupled with an action of a shift lever which is mounted on the boat. The link member 24 converts rotation motion of the shift rod 23 into linear motion along the axial direction of the propeller shaft 15 and transmits the motion to the shift sleeve 22. As a result of this arrangement, the dog clutch 19 moves to the forward progression position, the backward progression position, and the neutral position in accordance with an operation of the shift lever.

The forward progression bevel gear 17 and the backward progression bevel gear 18 are each selectively switched to a released state and a fixed state in accordance with the position of the dog clutch 19. In the forward progression position, the dog clutch 19 sets the forward progression bevel gear 17 in the fixed state and sets the backward progression bevel gear 18 in the released state. In the fixed state, the forward progression bevel gear 17 is not allowed to relatively rotate with respect to the propeller shaft 15. In the released state, the backward progression bevel gear 18 is allowed to relatively rotate with respect to the propeller shaft 15. In this case, the rotation of the drive shaft 12 is transferred to the propeller shaft 15 via the forward progression bevel gear 17. Thus, the propeller 14 rotates in a direction in which the boat progresses forward.

In the backward progression position, the dog clutch 19 sets the forward progression bevel gear 17 in the released state and sets the backward progression bevel gear 18 in the fixed state. In the released state, the forward progression bevel gear 17 is allowed to relatively rotate with respect to the propeller shaft 15. In the fixed state, the backward progression bevel gear 18 is not allowed to relatively rotate with respect to the propeller shaft 15. In this case, the rotation of the drive shaft 12 is transferred to the propeller shaft 15 via the backward progression bevel gear 18. Thus, the propeller 14 rotates in a direction in which the boat progresses backward. In a case in which the dog clutch 19 is positioned at the neutral position between the forward progression position and the backward progression position, the forward progression bevel gear 17 and the backward progression bevel gear 18 are allowed to each relatively rotate with respect to the propeller shaft 15. That is, the rotation from the drive shaft 12 is not transmitted to the propeller shaft 15, and the propeller shaft 15 is idle.

The lower casing 8 includes a first storage space 26, a second storage space 27, and a third storage space 28 at an inner portion thereof. The first storage space 26 extends downward from an upper section of the lower casing 8. The first storage space 26 houses the drive shaft 12. An upper section of the first storage space 26 includes an expanded space 29 which extends outward further than the other portions. The second storage space 27 extends downward from the upper section of the lower casing 8. An upper section of the second storage space 27 communicates with the expanded space 29 of the first storage space 26 via a communication passage 291. The third storage space 28 is disposed below the first storage space 26 and the second storage space 27. The third storage space 28 communicates with a lower section of the first storage space 26. The third storage space 28 communicates with a lower section of the second storage space 27. The third storage space 28 houses the forward and backward progression switching mechanism 13 and the propeller shaft 15.

The third storage space 28 houses an inner housing 31. The inner housing 31 houses a shaft section of the backward progression bevel gear 18. In addition, the inner housing 31 houses a portion of the propeller shaft 15.

Lubricating oil is filled into the first storage space 26, the second storage space 27, and the third storage space 28. A groove 121 with a spiral shape is provided on the circumferential surface of the drive shaft 12. The lubricating oil is drawn up to the first storage space 26 from the third storage space 28 by the rotation of the drive shaft 12. Then, the lubricating oil flows into the second storage space 27 from the first storage space 26 through the communication passage 291, and after this, returns to the third storage space 28. In this manner, a lubricating oil system is configured so that the lubricating oil circulates in the first storage space 26, the second storage space 27, and the third storage space 28.

Figure 3:
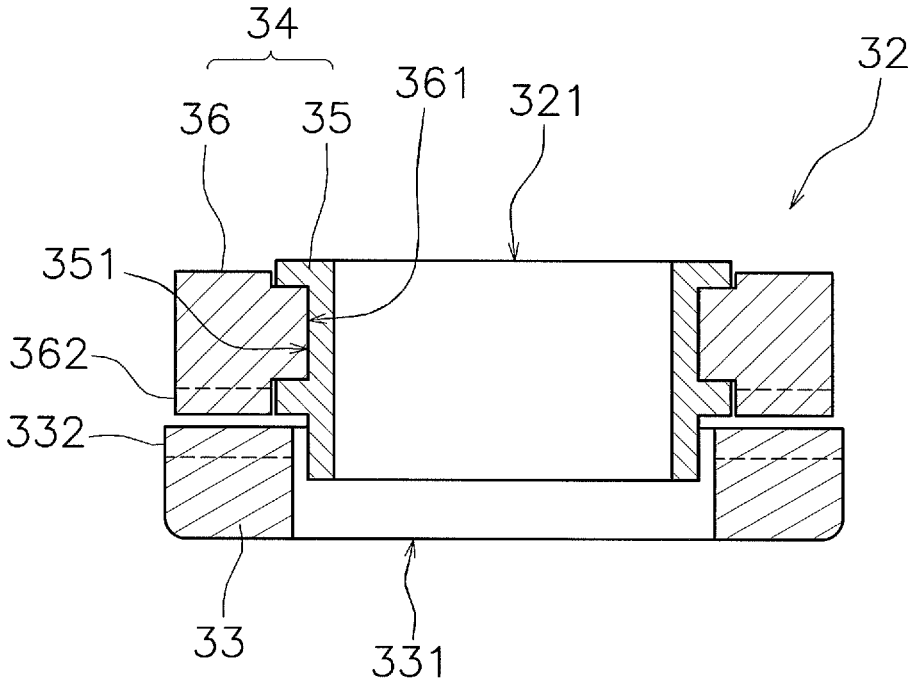
FIG. 3 is an enlarged cross-sectional diagram of a clutch of the marine propulsion device according to the first preferred embodiment of the present invention.

The marine propulsion device 1 includes a clutch 32. The clutch 32 is stored in the expanded space 29 of the first storage space 26. FIG. 3 is an enlarged cross-sectional diagram of the clutch 32. The clutch 32 is attached between the drive shaft 12 and the lower casing 8. The clutch 32 has a ring shape which includes an opening 321. The drive shaft 12 is inserted in the opening 321 of the clutch 32. The clutch 32 is preferably a one-way clutch. That is, the clutch 32 permits relative rotation between the drive shaft 12 and the lower casing 8 by opening a connection between the drive shaft 12 and the lower casing 8 during normal rotation of the drive shaft 12. The clutch 32 prevents the relative rotation between the drive shaft 12 and the lower casing 8 by connecting the drive shaft 12 and the lower casing 8 during reverse rotation of the drive shaft 12.

The clutch 32 includes a housing section-side gear 33 and a drive shaft-side gear 34. The drive shaft-side gear 34 is attached to the drive shaft 12. The housing section-side gear 33 is attached to the lower casing 8. The drive shaft-side gear 34 includes a holder housing 35 and a gear member 36.

Figure 4:
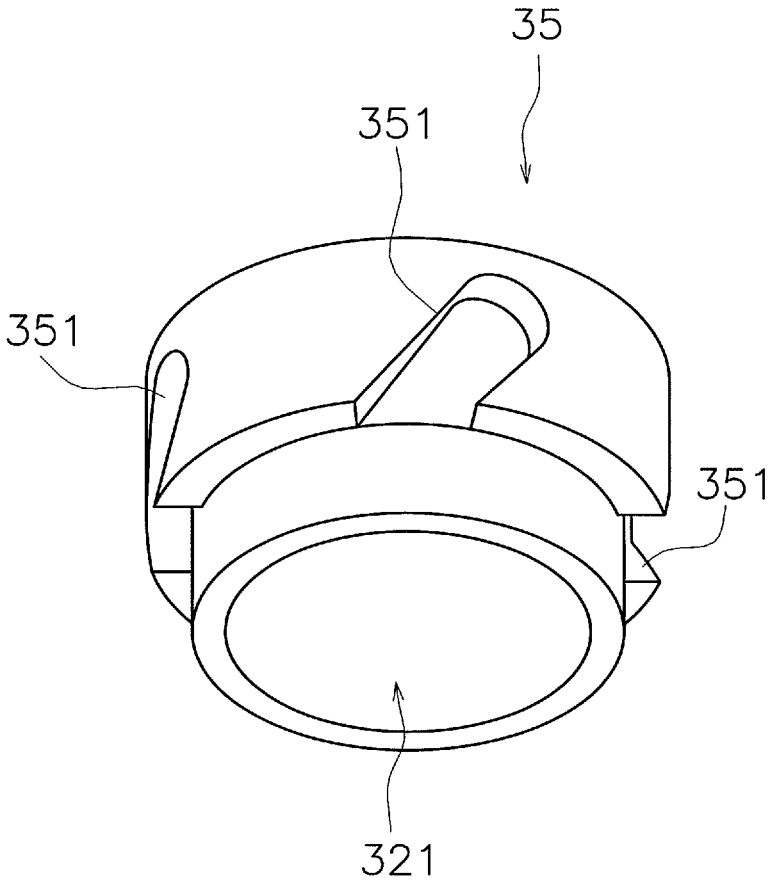
FIG. 4 is a perspective view of a holder housing of the clutch.
Figure 5:
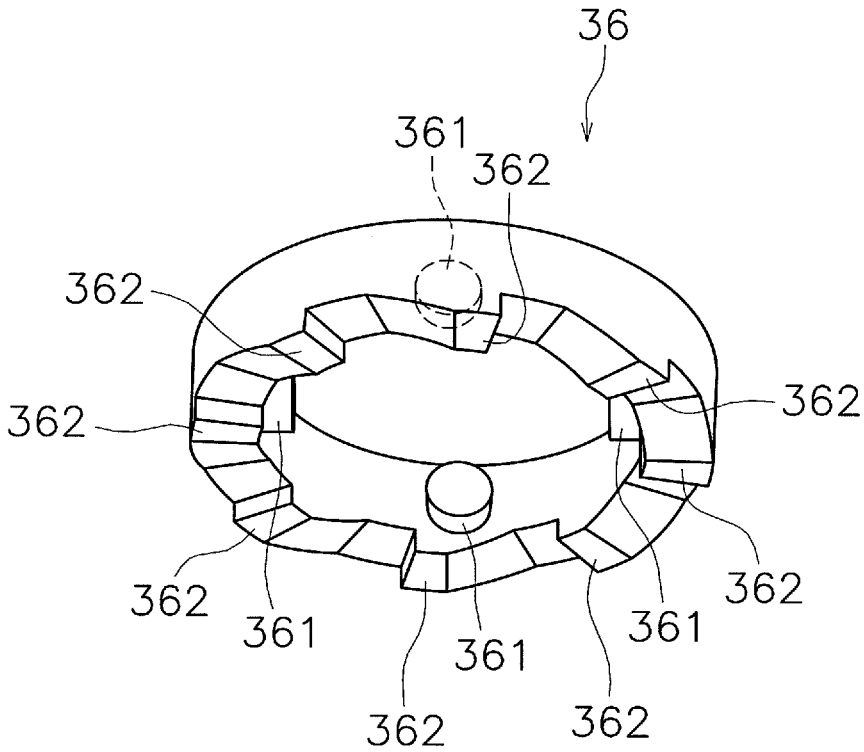
FIG. 5 is a perspective view of a gear member of the clutch.

FIG. 4 is a perspective view of the holder housing 35. The holder housing 35 has a ring shape. The drive shaft 12 is inserted into the opening 321 of the holder housing 35 by press-fitting, for example. As a result this arrangement, the holder housing 35 is attached to the drive shaft 12. The surface of the holder housing 35 includes a plurality of grooves 351 which are inclined in a circumferential direction. FIG. 5 is a perspective view of the gear member 36. The gear member 36 is movably attached with respect to the holder housing 35. The gear member 36 includes a plurality of protrusion sections 361. The protrusion sections 361 protrude from an inner circumferential surface of the gear member 36 toward the inside. The gear member 36 is attached to the holder housing 35 via the protrusion sections 361. The protrusion sections 361 move along the grooves 351 of the holder housing 35 due to the relative rotation of the gear member 36 with respect to the holder housing 35. A plurality of teeth sections 362 are provided on a lower surface of the gear member 36.

Figure 6:
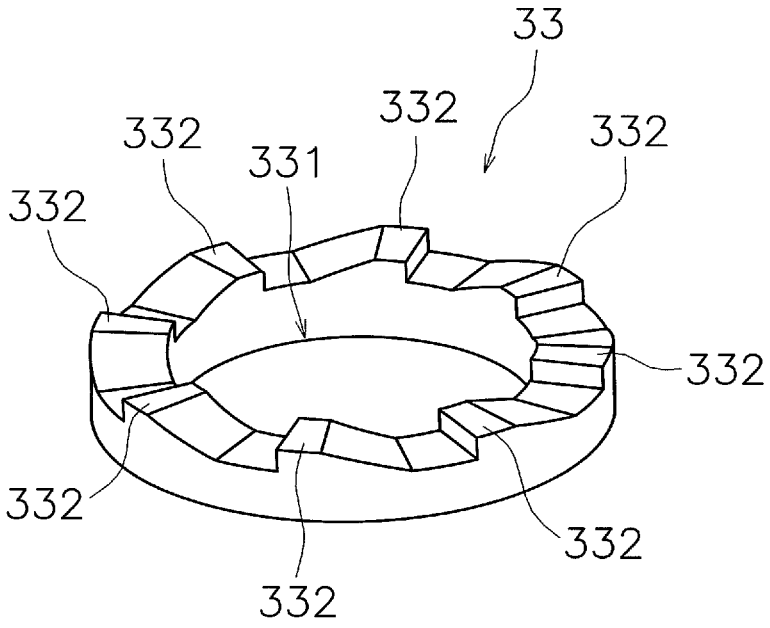
FIG. 6 is a perspective view of a gear on the housing section side in the clutch.

FIG. 6 is a perspective view of the housing section-side gear 33. The housing section-side gear 33 is inserted into the expanded space 29 of the lower casing 8 by press-fitting, for example. As a result of this arrangement, the housing section-side gear 33 is attached to the lower casing 8. The drive shaft 12 is inserted into an opening 331 of the housing section-side gear 33. The inner diameter of the opening 331 of the housing section-side gear 33 is larger than the outer diameter of the drive shaft 12. Accordingly, the housing section-side gear 33 is disposed so as to not come into contact with the drive shaft 12. A plurality of teeth sections 332 are provided on an upper surface of the housing section-side gear 33. The housing section-side gear 33 is disposed below the gear member 36.

As shown in FIG. 2, a roller bearing 37, a needle bearing 38, and a seal member 39 are disposed above the clutch 32. The drive shaft 12 includes a first shaft section 12*a*, a second shaft section 12*b*, a third shaft section 12*c*, and a fourth shaft section 12*d*. The second shaft section 12*b* is disposed above the first shaft section 12*a*. The outer diameter of the second shaft section 12*b* is smaller than the outer diameter of the first shaft section 12*a*. The holder housing 35 described above is attached to the second shaft section 12*b*. The third shaft section 12*c* is disposed above the second shaft section 12*b*. The outer diameter of the third shaft section 12*c* is smaller than the outer diameter of the second shaft section 12*b*. The third shaft section 12*c* is supported by the roller bearing 37 and the needle bearing 38. A gap between the roller bearing 37 and the inner surface of the expanded space 29 and a gap between the needle bearing 38 and the inner surface of the expanded space 29 is closed off by a lid member 41. The outer diameter of the fourth shaft section 12*d* is smaller than the outer diameter of the third shaft section 12*c*. The seal member 39 is attached to the fourth shaft section 12*d*. The seal member 39 seals a gap between an upper section of the lid member 41 and the drive shaft 12.

Figure 7:
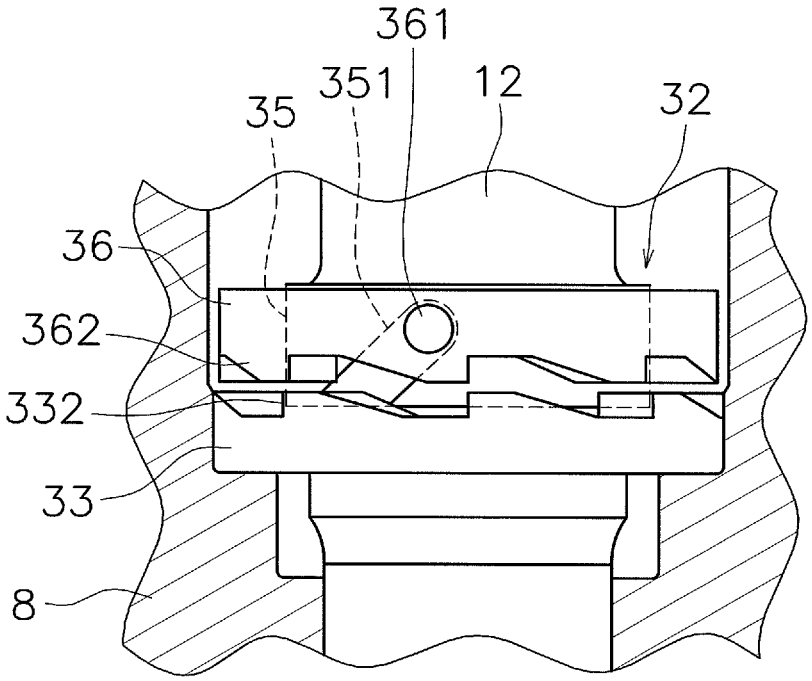
FIG. 7 is a diagram illustrating a state of the clutch during normal rotation of a drive shaft.

FIG. 7 illustrates a state of the clutch 32 during normal rotation of the drive shaft 12. When the drive shaft 12 rotates normally, i.e., forwardly, the protrusion sections 361 of the gear member 36 move upward so that the gear member 36 is separated from the housing section-side gear 33 due to the movement upward along the grooves 351 of the holder housing 35. As a result of this arrangement, the engagement of the teeth sections 362 of the gear member 36 and the teeth sections 332 of the housing section-side gear 33 is released. While the drive shaft 12 continues normal rotation, a state is maintained in which engagement of the drive shaft-side gear 34 and the housing section-side gear 33 is released.

Figure 8:
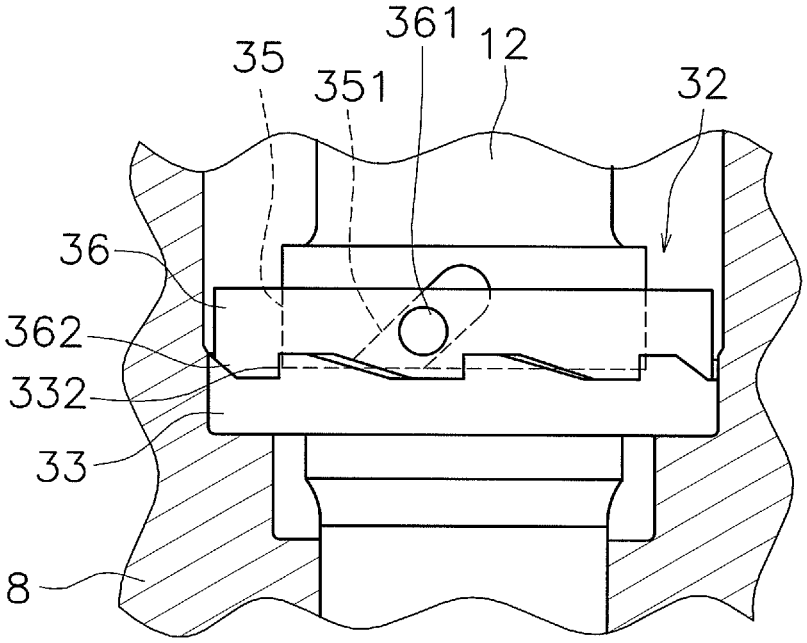
FIG. 8 is a diagram illustrating a state of the clutch during reverse rotation of the drive shaft.

FIG. 8 illustrates a state of the clutch 32 during reverse rotation of the drive shaft 12. When the drive shaft 12 rotates in reverse, the protrusion sections 361 of the gear member 36 move downward so that the gear member 36 comes closer to the housing section-side gear 33 due to movement downward along the grooves 351 of the holder housing 35. Then, the drive shaft 12 and the lower casing 8 are connected by the engagement of the teeth sections 332 of the housing section-side gear 33 and the teeth sections 362 of the gear member 36. As a result of this arrangement, it is possible to prevent reverse rotation of the drive shaft 12.

In the marine propulsion device 1 according to the present preferred embodiment, the clutch 32 connects the drive shaft 12 and the lower casing 8 during reverse rotation of the motive force transmission system 4. As a result of this arrangement, relative rotation between the drive shaft 12 and the lower casing 8 is prevented. That is, it is possible to prevent the occurrence of the inversion phenomenon. Furthermore, it is possible to swiftly and effectively prevent the occurrence of the inversion phenomenon since detection of the inversion phenomenon and control of the shift state are not necessary. In addition, the clutch 32 opens the connection of the drive shaft 12 and the lower casing 8 during normal rotation of the motive force transmission system 4. As a result of this arrangement, the clutch 32 permits the relative rotation between the drive shaft 12 and the lower casing 8 during normal rotation of the motive force transmission system 4. Accordingly, it is not necessary to segment the upstream portion and the downstream portion of the drive shaft 12 using the clutch 32. As a result, it is possible to maintain durability of the motive force transmission system 4.

The clutch 32 is disposed inside the first storage space 26. In addition, the forward and backward progression switching mechanism 13 is disposed in the third storage space 28. The first storage space 26 communicates with the second storage space 27 and the third storage space 28, and the lubricating oil circulates in the first storage space 26, the second storage space 27, and the third storage space 28 due to the rotation of the drive shaft 12. Accordingly, the clutch 32 and the forward and backward progression switching mechanism 13 are lubricated by the same lubricating system.

The drive shaft 12 is inserted into the holder housing 35 by press-fitting, for example. As a result, it is possible for the drive shaft 12 to slip with respect to the holder housing 35 when an excessive load is imparted to the drive shaft 12 due to reverse rotation of the drive shaft 12. Accordingly, for example, compared to a case in which the drive shaft 12 and the holder housing 35 are connected by a spline, it is possible to prevent damage to the drive shaft 12 or the holder housing 35. In the same manner, the housing section-side gear 33 is inserted into the lower casing 8 by press-fitting, for example. As a result, it is possible for the housing section-side gear 33 to slip with respect to the lower casing 8 when an excessive load is imparted to the housing section-side gear 33 due to the reverse rotation of the drive shaft 12. As a result, it is possible to prevent damage to the housing section-side gear 33 or the lower casing 8.

Figure 9:
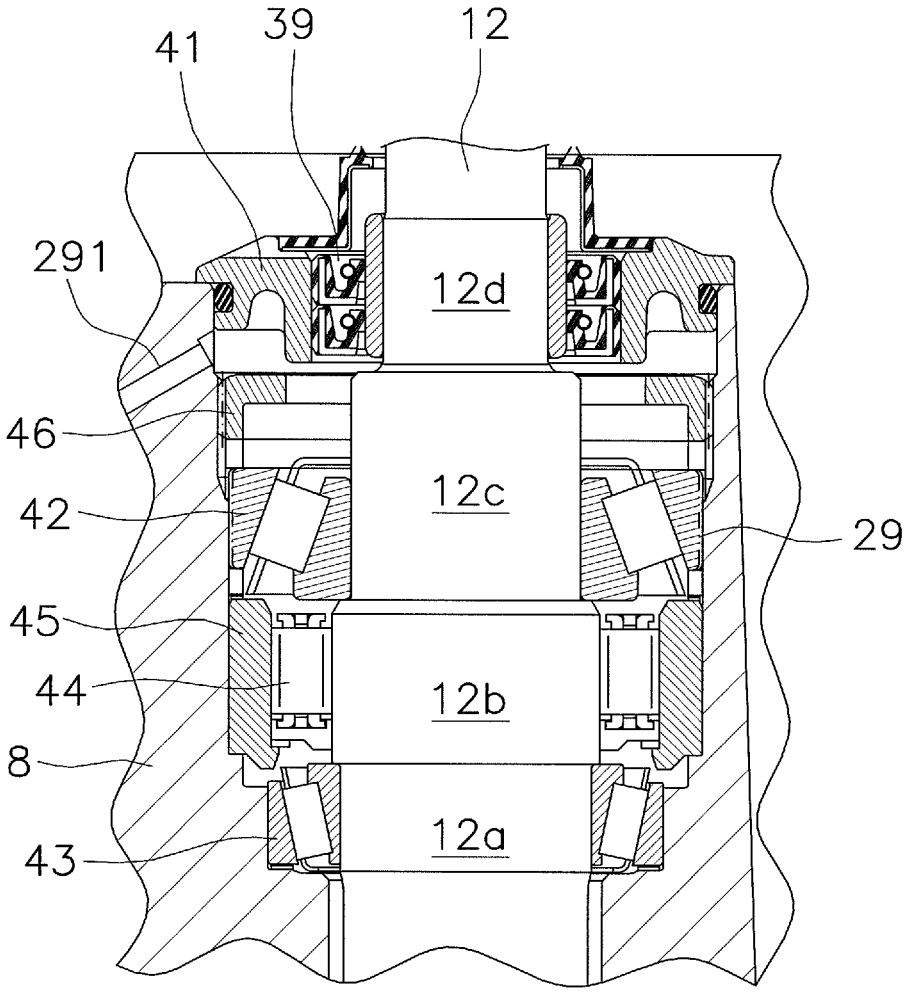
FIG. 9 is a cross-sectional diagram illustrating a structure within a lower casing of a marine propulsion device according to a second preferred embodiment of the present invention.

Next, a marine propulsion device according to a second preferred embodiment of the present invention will be described. FIG. 9 is a cross-sectional diagram illustrating a structure within the lower casing 8 of the marine propulsion device according to the second preferred embodiment. As shown in FIG. 9, the marine propulsion device according to the second preferred embodiment includes a first tapered bearing 42, a second tapered bearing 43, and a clutch 44. The first tapered bearing 42, the second tapered bearing 43, and the clutch 44 are disposed in the expanded space 29 of the first storage space 26.

The first tapered bearing 42 supports the third shaft section 12*c* of the drive shaft 12. A nut 46 and a lid member 41 are disposed above the first tapered bearing 42. The nut 46 is disposed between the first tapered bearing 42 and the lid member 41. A gap between the lid member 41 and the fourth shaft section 12*d* of the drive shaft 12 is sealed by the seal member 39.

The second tapered bearing 43 supports the first shaft section 12*a* of the drive shaft 12. The second tapered bearing 43 is disposed in a position which is closer to a propeller shaft 15 than is the first tapered bearing 42. That is, the second tapered bearing 43 is disposed further downward than the first tapered bearing 42. The outer diameter of the second tapered bearing 43 is smaller than the outer diameter of the first tapered bearing 42.

The clutch 44 is attached between the drive shaft 12 and the lower casing 8. The clutch 44 is disposed between the first tapered bearing 42 and the second tapered bearing 43. The outer diameter of the clutch 44 is smaller than the outer diameter of the first tapered bearing 42. As a result, a spacer 45 is disposed between the outer circumferential surface of the clutch 44 and the inner surface of the expanded space 29. The spacer 45 is inserted into the inner circumferential surface of the expanded space 29 by press-fitting, for example, and is fixed so as not to relatively rotate with respect to the expanded space 29. In the marine propulsion device according to the second preferred embodiment, the outer diameter of the second shaft section 12*b* is larger than the outer diameter of the first shaft section 12*a*. The clutch 44 is preferably a one-way clutch. That is, the clutch 44 permits relative rotation between the drive shaft 12 and the lower casing 8 by opening a connection between the drive shaft 12 and the lower casing 8 during normal rotation of the drive shaft 12. The clutch 44 prevents the relative rotation between the drive shaft 12 and the lower casing 8 by closing a connection between the drive shaft 12 and the lower casing 8, i.e., connecting the drive shaft 12 with the lower casing 8, during reverse rotation of the drive shaft 12.

Description of other configurations of the marine propulsion device according to the second preferred embodiment will be omitted since the configurations are preferably the same as the marine propulsion device 1 according to the first preferred embodiment. In the marine propulsion device according to the second preferred embodiment, it is possible to prevent the occurrence of the inversion phenomenon while maintaining durability of the motive force transmission system in the same manner as the marine propulsion device 1 according to the first preferred embodiment.

Figure 10:
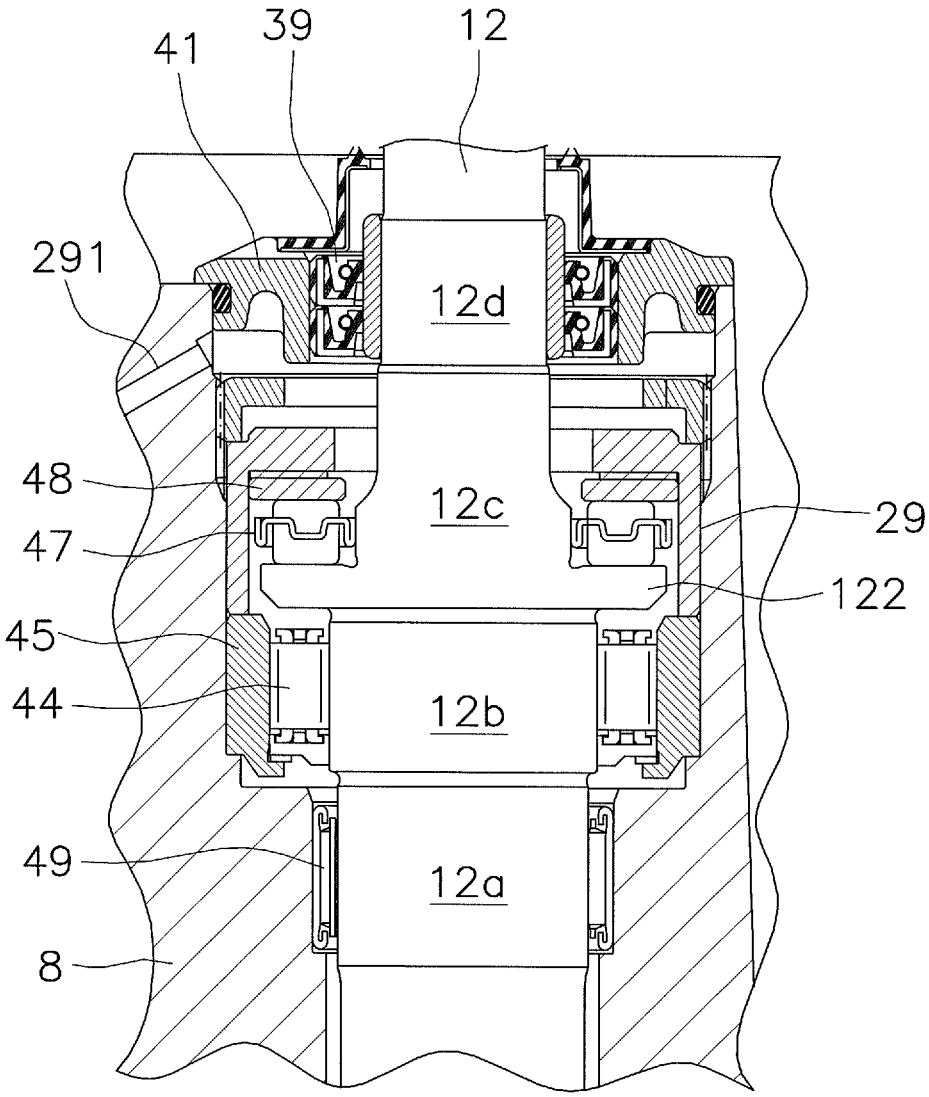
FIG. 10 is a cross-sectional diagram illustrating a modified example of the marine propulsion device according to the second preferred embodiment of the present invention.

As shown in FIG. 10, a thrust bearing 47 may be used instead of the first tapered bearing 42. In this case, a flange section 122 is provided in the third shaft section 12*c*. In addition, a spacer 48 is disposed between the thrust bearing 47 and the lid member 41. The thrust bearing 47 is disposed between the flange section 122 and the spacer 48. In addition, as shown in FIG. 10, a needle bearing 49 may be used instead of the second tapered bearing 43. The outer diameter of the needle bearing 49 is smaller than the outer diameter of the clutch 44.

Figure 11:
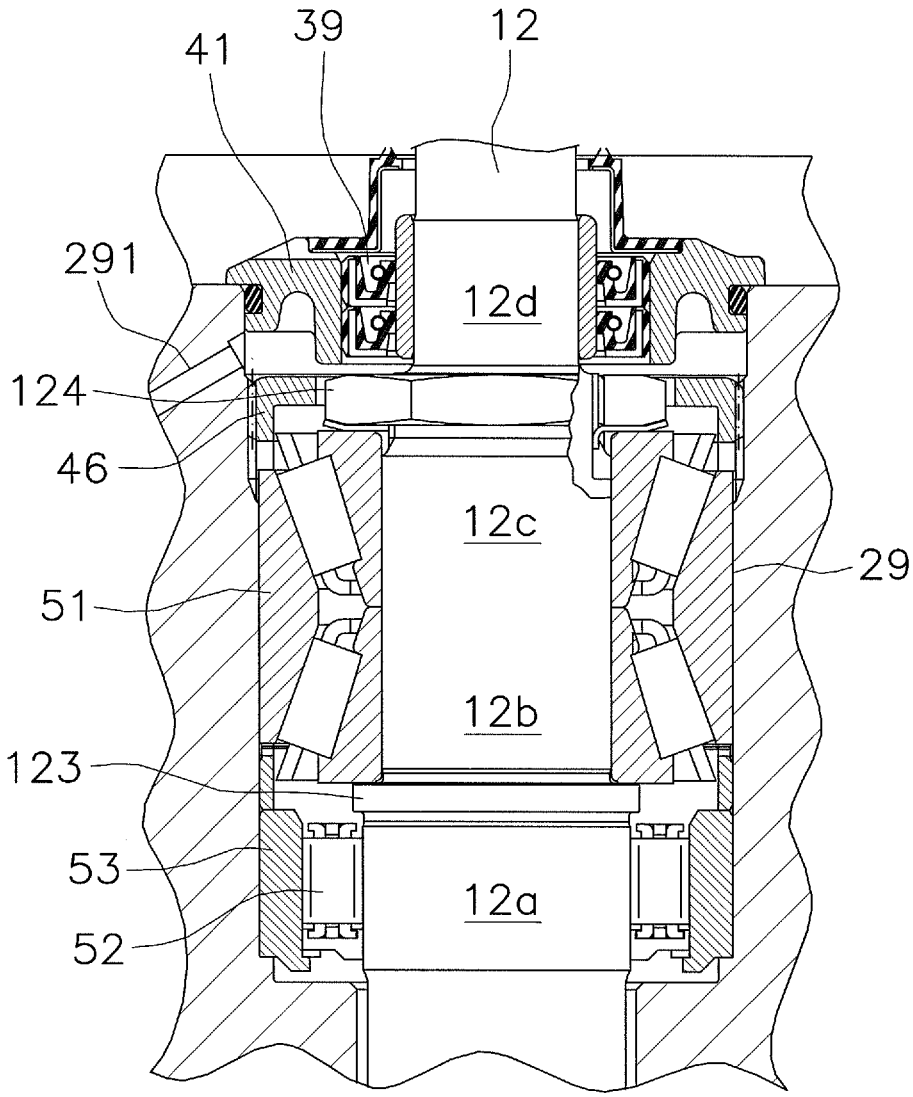
FIG. 11 is a cross-sectional diagram illustrating another modified example of the marine propulsion device according to the second preferred embodiment of the present invention.

Alternatively, as shown in FIG. 11, a double tapered bearing 51 and a clutch 52 may be used in the expanded space 29 of the first storage space 26. The clutch 52 is preferably a one-way clutch in a similar manner to the clutch 44 in the preferred embodiments described above. The clutch 52 supports the first shaft section 12*a*. A spacer 53 is disposed between an outer circumferential surface of the clutch 52 and the inner circumferential surface of the expanded space 29. The spacer 53 is inserted into the inner circumferential surface of the expanded space 29 by press-fitting, for example, and is fixed so as to not relatively rotate with respect to the expanded space 29. The double tapered bearing 51 is disposed above the clutch 52. The double tapered bearing 51 supports the second shaft section 12*b* and the third shaft section 12*c*. In this case, the outer diameter of the second shaft section 12*b* and the outer diameter of the third shaft section 12*c* are the same. The outer diameter of the second shaft section 12*b* and the third shaft section 12*c* is smaller than the outer diameter of the first shaft section 12*a*. The outer diameter of the second shaft section 12*b* and the third shaft section 12*c* is larger than the outer diameter of the fourth shaft section 12*d*. However, a flange section 123 is provided between the first shaft section 12*a* and the second shaft section 12*b*. In addition, a bolt 124 is attached between the third shaft section 12*c* and the fourth shaft section 12*d*. The double tapered bearing 51 is retained in an axial direction by the flange section 123 and the bolt 124.

Figure 12:
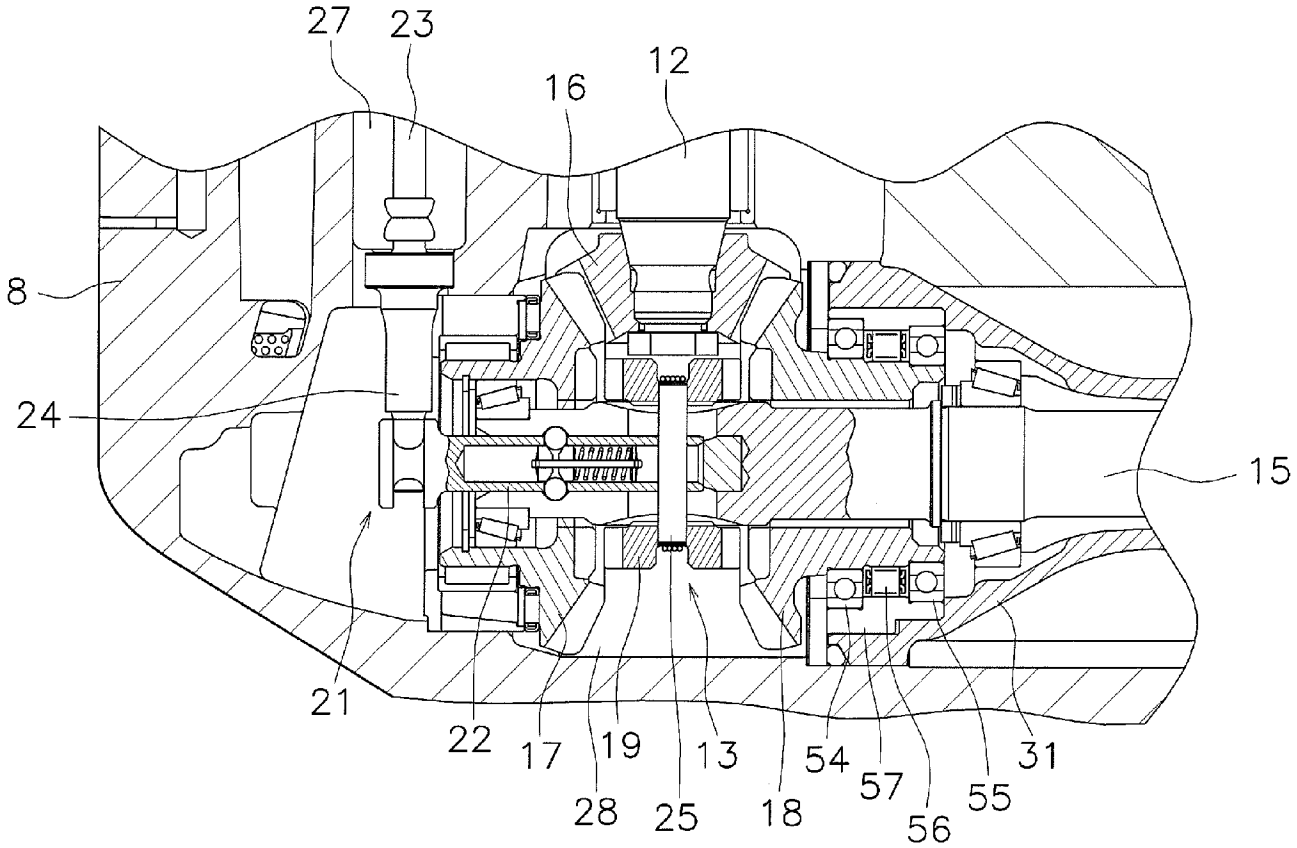
FIG. 12 is a cross-sectional diagram illustrating a structure within a lower casing of a marine propulsion device according to a third preferred embodiment of the present invention.

Next, a marine propulsion device according to a third preferred embodiment of the present invention will be described. FIG. 12 is a partial cross-sectional diagram illustrating a structure within the lower casing of a marine propulsion device according to the third preferred embodiment. As shown in FIG. 12, the marine propulsion device according to the third preferred embodiment includes a first bearing 54, a second bearing 55, and a clutch 56. The first bearing 54, the second bearing 55, and the clutch 56 are disposed inside an inner housing 31. The first bearing 54, the second bearing 55, and the clutch 56 support a shaft section of the backward progression bevel gear 18. The first bearing 54 is positioned further upstream in the transmission direction of the motive force than is the second bearing 55 in the motive force transmission system 4. The clutch 56 is disposed between the first bearing 54 and the second bearing 55 in the axial direction of the propeller shaft 15. The first bearing 54, the second bearing 55, and the clutch 56 are attached between the backward progression bevel gear 18 and the inner housing 31.

The clutch 56 is preferably a one-way clutch. That is, the clutch 56 permits relative rotation between the backward progression bevel gear 18 and the inner housing 31 by opening a connection between the backward progression bevel gear 18 and the inner housing 31 during normal rotation of the motive force transmission system 4. In addition, the clutch 56 prevents relative rotation between the backward progression bevel gear 18 and the inner housing 31 by closing a connection between the backward progression bevel gear 18 and the inner housing 31 during reverse rotation of the motive force transmission system 4. The inner diameter of the clutch 56 is smaller than the inner diameter of the first bearing 54. In addition, the inner diameter of the second bearing 55 is smaller than the inner diameter of the clutch 56. The outer diameter of the clutch 56 is smaller than the outer diameter of the first bearing 54. In addition, the outer diameter of the second bearing 55 is larger than the outer diameter of the clutch 56. A spacer 57 is disposed between the outer circumferential surfaces of the first bearing 54, the second bearing 55, and the clutch 56 and the inner circumferential surface of the inner housing 31.

Description of other configurations of the marine propulsion device according to the third preferred embodiment will be omitted since the configurations are preferably the same as the marine propulsion device 1 according to the first preferred embodiment. In the marine propulsion device according to the third preferred embodiment, in the same manner as the marine propulsion device 1 according to the first preferred embodiment, it is possible to prevent the occurrence of the inversion phenomenon while maintaining durability of the motive force transmission system.

Preferred embodiments of the present invention have been described above, but the present invention is not limited to the preferred embodiments described above and various changes are possible within a scope which does not depart from the gist of the present invention. For example, preferred embodiments of the present invention are not limited to an outboard motor and may be applied to another marine propulsion device such as an inboard-outdrive engine.

Figure 13:
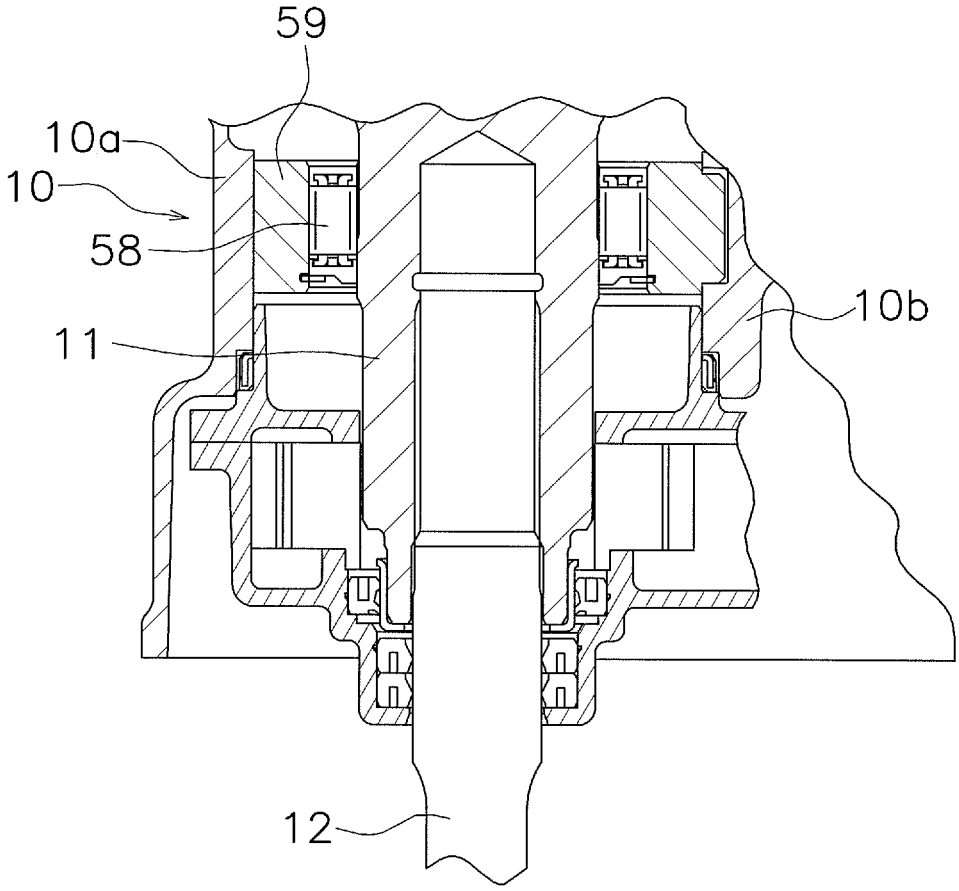
FIG. 13 is a cross-sectional diagram illustrating a structure within a case section of a marine propulsion device according to another preferred embodiment of the present invention.

The clutch may be attached to a portion other than the lower casing 8 or the drive shaft 12. For example, the clutch may be attached to the upper casing 7. Alternatively, the clutch may be attached between the crank shaft 11 and the case section 10 of the engine 3 in the same manner as the clutch 58 which is shown in FIG. 13. Here, a spacer 59 is disposed between the clutch 58 and the case section 10. In this case, the clutch 58 permits relative rotation between the crank shaft 11 and the case section 10 by opening a connection between the crank shaft 11 and the case section 10 during normal rotation of the motive force transmission system 4. In addition, the clutch 58 prevents relative rotation between the crank shaft 11 and the case section 10 by closing a connection between the crank shaft 11 and the case section 10 during reverse rotation of the motive force transmission system 4. With such a configuration, it is possible to prevent reverse rotation of the motive force transmission system 4 using the clutch 58. In addition, since it is not necessary to segment the crank shaft 11, it is possible to maintain durability of the motive force transmission system 4. The crank shaft 11 is not limited to being located between the crank case 10*a* and a cylinder body 10*b*, and may be disposed in an another position inside the case section 10.

In the third preferred embodiment described above, the clutch 56 preferably is attached to the backward progression bevel gear 18, but the clutch may be attached to the forward progression bevel gear 17. Alternatively, the clutch may be attached to the pinion gear 16. The clutch is not limited to a one-way clutch, and may be a clutch such as an electromagnetic clutch.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion device comprising:

a motive force transmission system including a crank shaft and a drive shaft arranged to transmit a motive force from the crank shaft;

a propeller shaft arranged to transmit the motive force from the drive shaft;

a housing section that houses the motive force transmission system; and a clutch attached between the motive force transmission system and the housing section, the clutch being arranged to permit relative rotation between the motive force transmission system and the housing section by opening a connection between the motive force transmission system and the housing section during a forward rotation of the motive force transmission system, and to prevent the relative rotation between the motive force transmission system and the housing section by closing the connection between the motive force transmission system and the housing section during a reverse rotation of the motive force transmission system.

2. The marine propulsion device according to claim 1, wherein the propeller shaft rotates in different directions during a forward progression and during a backward progression of the marine propulsion device; and the motive force transmission system rotates in the same direction during either the forward progression or the backward progression.

3. The marine propulsion device according to claim 2, wherein the clutch is a one-way clutch.

4. The marine propulsion device according to claim 3, wherein the clutch is attached between the drive shaft and the housing section;

the housing section includes an upper casing and a lower casing which house the drive shaft; and the clutch is disposed inside the lower casing.

5. The marine propulsion device according to claim 4, wherein the motive force transmission system includes a forward and backward progression switching mechanism disposed inside the lower casing;

the forward and backward progression switching mechanism is arranged to switch a transmission direction of rotation from the drive shaft to the propeller shaft; and the clutch and the forward and backward progression switching mechanism are lubricated with a same lubricating system.

6. The marine propulsion device according to claim 4, wherein the clutch has a ring shape including an opening into which the drive shaft is inserted.

7. The marine propulsion device according to claim 6, wherein the clutch includes a housing section gear attached to the housing section and a drive shaft gear attached to the drive shaft; and the drive shaft and the housing section are connected by the housing section gear and the drive shaft gear being engaged during a reverse rotation of the drive shaft.

8. The marine propulsion device according to claim 7, wherein the drive shaft gear includes a holder housing fixed to the drive shaft and a gear member movably attached to the holder housing;

a surface of the holder housing includes a groove inclined in a circumferential direction;

the gear member includes a protrusion section, which moves along the groove of the holder housing, and the gear member is attached to the holder housing via the protrusion section; and engagement of the drive shaft gear and the housing section gear is released by the protrusion section moving along the groove during a forward rotation of the drive shaft.

9. The marine propulsion device according to claim 8, wherein the housing section gear is press-fitted into the housing section.

10. The marine propulsion device according to claim 8, wherein the drive shaft is press-fitted into the holder housing.

11. The marine propulsion device according to claim 3, further comprising:

a first tapered bearing supporting the drive shaft; and a second tapered bearing supporting the drive shaft, the second tapered bearing being disposed at a position closer to the propeller shaft than is the first tapered bearing; wherein the clutch is attached between the drive shaft and the housing section; and the clutch is disposed between the first tapered bearing and the second tapered bearing.

12. The marine propulsion device according to claim 11, wherein an outer diameter of the second tapered bearing is smaller than an outer diameter of the first tapered bearing.

13. The marine propulsion device according to claim 3, further comprising:

a thrust bearing supporting the drive shaft, the thrust bearing being disposed farther upstream than the clutch in a motive force transmission direction of the motive force transmission system; wherein the clutch is attached between the drive shaft and the housing section.

14. The marine propulsion device according to claim 3, wherein the motive force transmission system includes:

a pinion gear connected to the drive shaft; and a bevel gear engaged with the pinion gear, the bevel gear being arranged to selectively switch between a released state in which relative rotation is allowed with respect to the propeller shaft and a fixed state in which relative rotation is not allowed with respect to the propeller shaft; and the clutch is attached between the pinion gear or the bevel gear and the housing section.

15. The marine propulsion device according to claim 14, wherein the housing section includes an upper casing, a lower casing, and an inner housing disposed inside the lower casing and houses the bevel gear; and the clutch is attached between the bevel gear and the inner housing.

16. The marine propulsion device according to claim 3, wherein the housing section includes a case section housing the crank shaft; and the clutch is attached between the crank shaft and the case section.

17. The marine propulsion device according to claim 1, wherein the clutch does not segment the motive force transmission system into an upstream portion and a downstream portion.

* * * * *